US011655659B2

(12) United States Patent
Deutsch

(10) Patent No.: US 11,655,659 B2
(45) Date of Patent: May 23, 2023

(54) QUICK RELEASE DOOR ROLLER ASSEMBLY

(71) Applicant: Daniel A. Deutsch, Ringoes, NJ (US)

(72) Inventor: Daniel A. Deutsch, Ringoes, NJ (US)

(73) Assignee: Daniel Deutsch, Ringoes, NJ (US)

( * ) Notice: Subject to any disclaimer, the term of this patent is extended or adjusted under 35 U.S.C. 154(b) by 373 days.

(21) Appl. No.: 16/897,460

(22) Filed: Jun. 10, 2020

(65) Prior Publication Data

US 2021/0388655 A1 Dec. 16, 2021

(51) Int. Cl.
*E05D 15/22* (2006.01)
*E06B 3/48* (2006.01)
*E05D 15/24* (2006.01)

(52) U.S. Cl.
CPC ..... *E05D 15/22* (2013.01); *E05D 15/242* (2013.01); *E06B 3/485* (2013.01); *E05D 2015/225* (2013.01); *E05Y 2900/106* (2013.01)

(58) Field of Classification Search
CPC .... E06B 3/485; E06B 2009/585; E06B 9/581; E06B 3/5063; E06B 2003/7044; E06B 2003/7057; E05D 15/165; E05D 2015/225; E05D 15/22; E05D 15/242; Y10T 403/32393; Y10T 403/32311; Y10T 403/32991
See application file for complete search history.

(56) References Cited

U.S. PATENT DOCUMENTS 702,204 A 6/1902 Hamilton
1,136,444 A * 4/1915 Schubert ..... E05C 17/32 217/60 F
2,171,065 A 8/1939 Johnson
3,305,204 A * 2/1967 Babin ..... A47G 25/0685 248/278.1
4,148,459 A 4/1979 Martinez
4,527,579 A * 7/1985 Knotter ..... A45B 9/00 403/100
4,537,237 A * 8/1985 Sepulveda ..... E05D 15/24 160/116
4,770,087 A 9/1988 Danley
5,056,579 A * 10/1991 Krafutler ..... E06B 9/581 160/264
5,535,805 A * 7/1996 Kellogg ..... E05D 15/165 160/281

(Continued)

FOREIGN PATENT DOCUMENTS

FR 2892908 B1 2/2008

OTHER PUBLICATIONS

International Search Report, U.S. Patent and Trademark Office, Application No. PCT/US2021/070644, dated Oct. 14, 2021.

(Continued)

*Primary Examiner* — Abe Massad
(74) *Attorney, Agent, or Firm* — Gottlieb, Rackman & Reisman P.C.

(57) ABSTRACT

An improved vertical lift door roller assembly has a wheel pivotally mounted to a shaft. The shaft is placed within a spring loaded locking cylinder. The locking cylinder is movable between a first position where it restricts pivoting of the wheel and a second position where the wheel is able to pivot. When the door roller assembly is used on a vertical lift door, the wheel can be pivoted to decouple the roller from a vertical lift door J channel wheel track.

22 Claims, 11 Drawing Sheets

(56) References Cited

U.S. PATENT DOCUMENTS

| | | | | |
|---|---|---|---|---|
| 5,601,133 | A * | 2/1997 | Krupke | E06B 9/13 160/265 |
| 5,829,504 | A * | 11/1998 | Ekstrand | E05D 15/165 160/277 |
| 6,148,897 | A * | 11/2000 | Horner | E06B 9/581 160/195 |
| 6,315,027 | B1 * | 11/2001 | Lichy | E06B 3/485 160/205 |
| 7,640,617 | B2 * | 1/2010 | Kennedy | A47L 13/20 403/90 |
| 10,077,590 | B2 * | 9/2018 | Faccone | E06B 3/485 |
| 2001/0027847 | A1 | 10/2001 | Horner | |
| 2002/0179254 | A1 | 12/2002 | Schulte | |
| 2004/0244352 | A1 * | 12/2004 | Weichholdt | A01D 63/04 56/314 |
| 2020/0355023 | A1 * | 11/2020 | Fazio | E06B 3/28 |

OTHER PUBLICATIONS

Written Opinion, U.S. Patent and Trademark Office, Application No. PCT/US2021/070644, dated Oct. 14, 2021.

* cited by examiner

QUICK RELEASE DOOR ROLLER ASSEMBLY

FIELD OF THE INVENTION

The present invention relates to an improved roller assembly for use with vertical lift doors and similar systems.

BACKGROUND

Vertical lift doors are very popular systems used on home and commercial garages and other spaces where a large entryway is required. A conventional door is comprised of a plurality of rectangle panels hinged together in a vertical array. A J-channel track runs vertically along each side of the door and then continues upwards or bends to run horizontally over the ceiling. Roller wheels are mounted on stems coupled to the door panels and the wheels ride within the J-track to hold the door in place and support it as the door is raised and lowered.

A drawback to a conventional garage door assembly is that the enclosed garage space cannot be ventilated without lifting the door. Lifting the door even partially creates an open space at the bottom of the door. However, doing this provides an opening through which anything at ground level, such as water or snow and animals, to enter. It may also provide a security risk by allowing easy access to the garage interior. In addition, partially opening the door may have only a limited effect on venting of hot air smoke, engine exhaust, or other emissions that rise to the top of the garage.

Another drawback is that it can be difficult to remove a roller wheel from the J-track or reseat a roller wheel into the track without unbolting the entire roller wheel mount and then rebolt it later. This can be difficult if the bolts are rusted, the loose parts can easily be lost, and users may simply prefer not to have to disassemble door hinges and brackets. An alternative is to bend the track to flatten out the J portion at one point, move the door so the wheel is next to the bent part of the track, and then pry the track away from and over the wheel at that point. The pry process is repeated to reinsert the wheel into the track and the track is then bent back into shape. Although this is suitable for occasional maintenance, the bending and prying cannot be done by hand. It can also damage the track and can increase the likelihood of a wheel jumping the track in the area where the track has been bent.

Accordingly, there is a need for an improved roller wheel assembly that can be easily seated into and removed from a J-track of a vertical lift door without having to deform the track. There is a further need for an improved roller wheel assembly that can be used on a garage door to allow the top panel or other panels of the door to be selectively detached from the track so that those panels can be dropped down to provide an opening at the top of the door. This opening can provide ventilation and other access to the garage space without having to lift the door up from the ground.

DESCRIPTION OF THE DRAWINGS

These and other needs are addressed by a quick release door roller assembly as disclosed in detail below with references to the accompanying drawings in which.

DETAILED DESCRIPTION

Figure 1A:
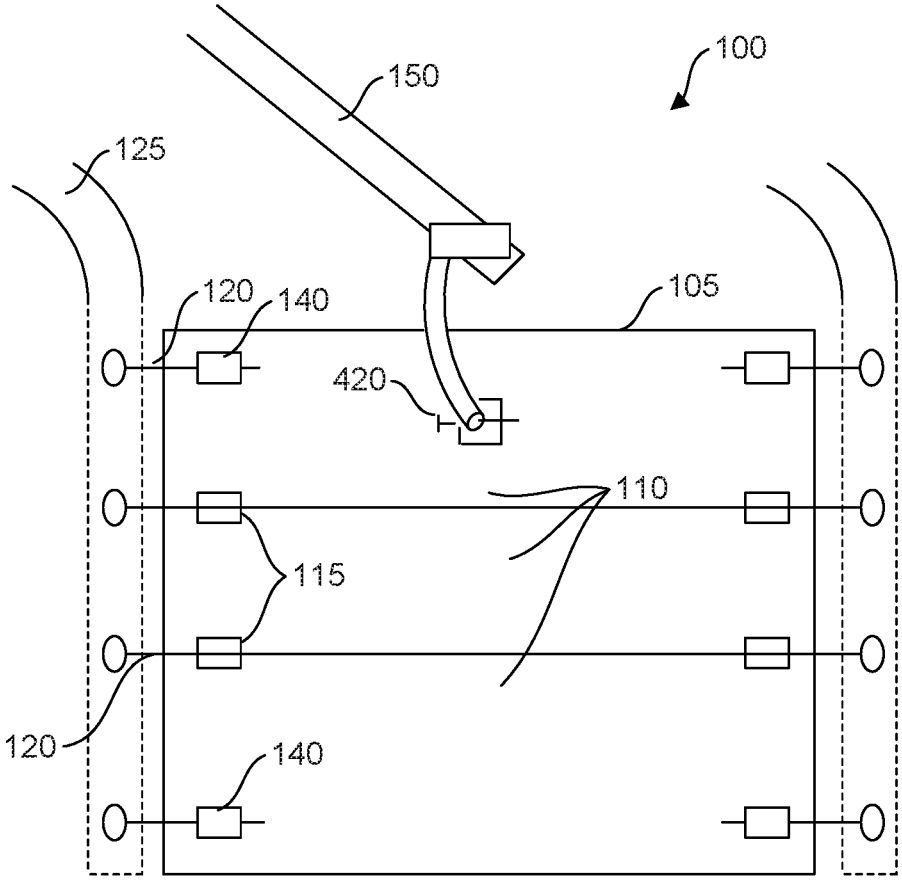
(Prior Art) FIG. 1A
FIGS. 1A and 1B illustrate a vertical lift door assembly with conventional (prior art) rollers.
Figure 1B:
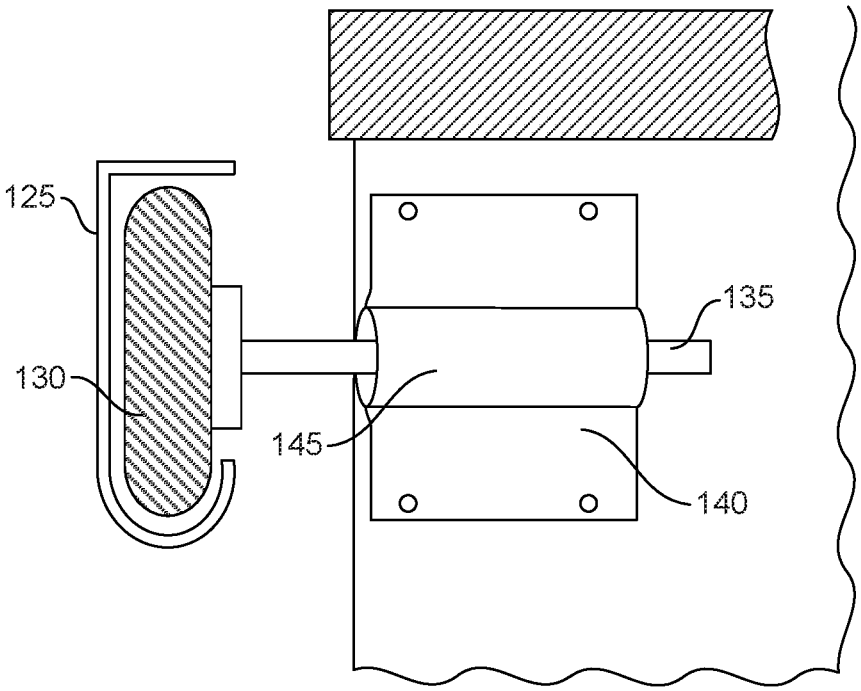
(Prior Art) FIG. 1B

FIGS. 1A and 1B are a schematic illustration of a conventional vertical lift door assembly 100, such as used in a home or commercial garage. The door assembly 100 has a door portion 105 which is generally comprised of a plurality of rectangular panels 110. Adjacent panels are connected by hinges 115. Each side of the door 100 is supported by a plurality of rollers 120 that ride in a J-channel track 125. Each roller is comprised of a wheel 130 and a stem 135. Typically a roller 120 is mounted adjacent each hinge 115 with the stem 135 of the roller 120 passing through a support formed on the hinge 115. In addition, rollers 120 are mounted adjacent each of the top and bottom corners of the door 100 using brackets 140 with the stem 135 passing through a support 145, such as a cylindrical receiver or a pair of rings. A lift assembly 150 can be used to raise and lower the door 100.

Figure 2A:
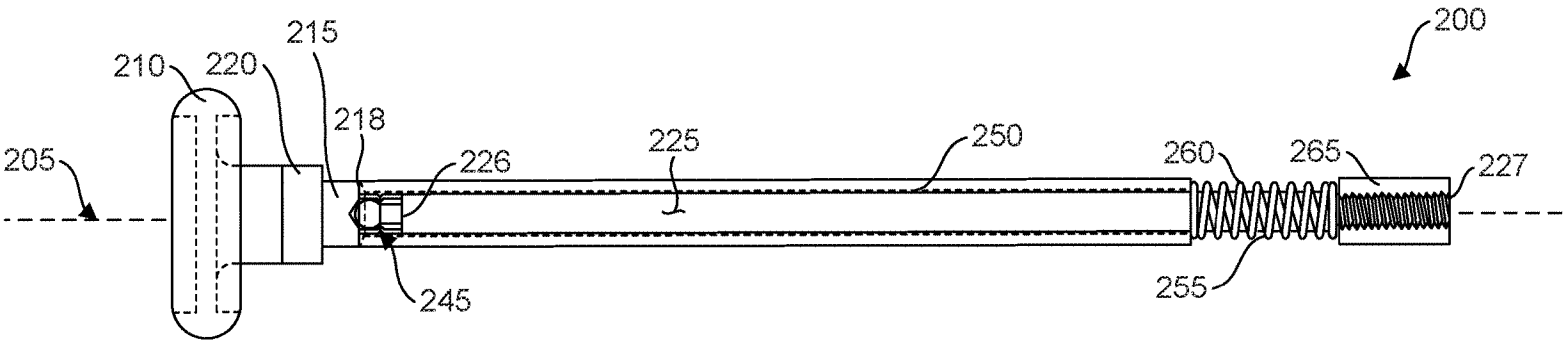
FIGS. 2A-2C illustrate an embodiment of an improved roller assembly according to aspects of the present invention.
Figure 2B:
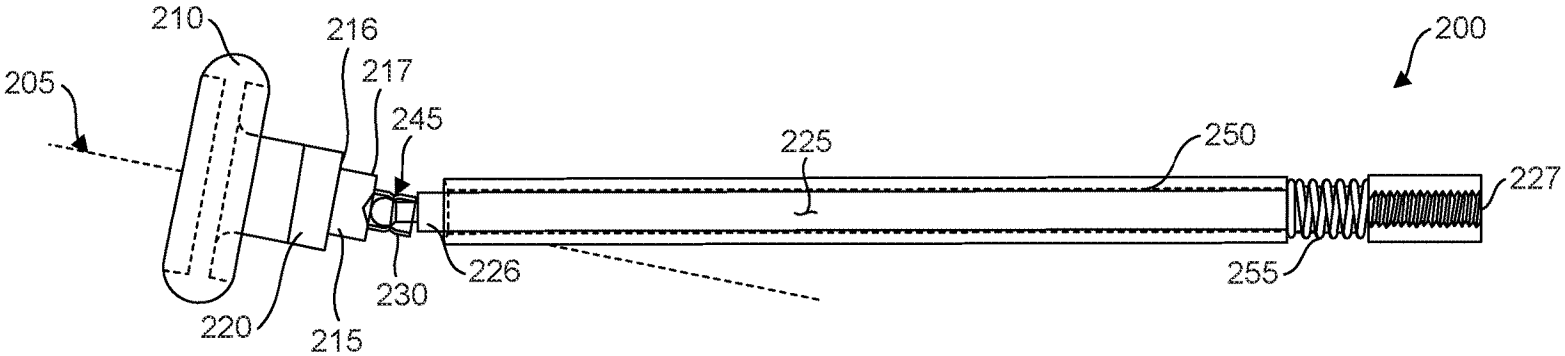
Figure 2C:
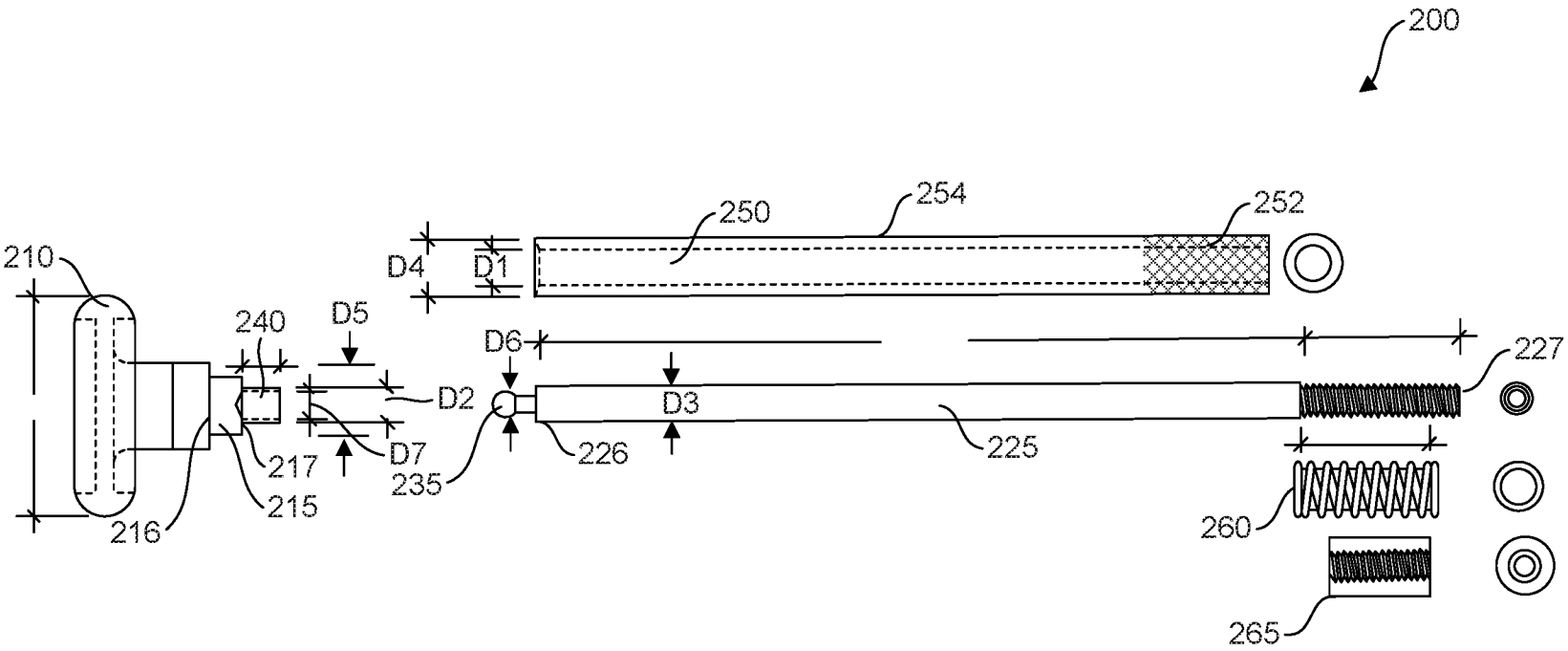

FIGS. 2A and 2B show an embodiment of an improved roller assembly 200. FIG. 2C is an exploded view of the assembly 200 of FIGS. 2A and 2B. Use of the improved roller assembly 200 allows sections of a vertical door to be easily detached and reconnected from the track without the use of tools or having to bend and then pry the J-track away from the wheel. In a particular use, the improved roller assembly 200 can be used to connect the top corners of the top panel of the door to the track. Decoupling the rollers from the track allows the top panel of the door to be dropped down to provide an opening for ventilation and other purposes without having to raise the door off of the floor.

With reference to FIGS. 2A-2C, roller assembly 200 comprises a wheel 210. A first shaft 215 is coupled to the wheel at an inner end 216 and extends along a central axis 205 away from the wheel to an outer end 217. The first shaft 215 can be coupled directly to the wheel 210 or indirectly, such as with a bearing assembly 220.

A second shaft 225 has inner and outer ends 226, 227. The inner end 226 of the second shaft is connected to the outer end 217 of the first shaft with a pivot joint 230. The pivot joint 230 allows the second shaft 225 to be offset at an angle relative to the central axis 205. The maximum offset angle should be sufficient enough to allow the wheel 210 to be tilted sufficiently for removal from the J-track in a manner as discussed below. The maximum offset angle could be 45 degrees, 30 degrees, 20 degrees, or even less depending on the overall dimensions of the wheel and depth of the track. In a particular embodiment, the pivot joint 230 allows for an offset of at least 10 degrees.

In the illustrated embodiment the pivot joint 230 is a ball and socket joint with a ball 235 extending from the inner end 226 of the second shaft 225 and seated within a socket 240 formed within the outer end 217 of the first shaft 215. A crimp 245 can be made in the socket 240 to retain the ball 235 in place. Other ball and socket designs can be used instead. Also, the ball and socket joint could be reversed, with the ball formed on the first shaft and the socket formed on the second shaft. Other types of pivot connections 230 known to those of ordinary skill in the art could also be used. Preferably the pivot joint allows the second shaft to be offset relative to the first in any direction around the axis 205. However, a more limited pivot joint, such as a simple hinge, could be used instead.

A locking cylinder 250 surrounds at least a portion of the second shaft 225. The internal diameter D1 of the locking cylinder 250, diameter D2 of the first shaft 215 at least in a region adjacent the outer end 217, and diameter D3 of the second shaft 225 (FIG. 2C) are sized so that the locking cylinder 250 can slide over the second shaft 225 and is movable between (i) a first position (FIG. 2A) in which the locking cylinder 250 surrounds at least a portion of the first shaft 215 and/or the pivot connection 230 and a portion of the second shaft 225 and (ii) a second position (FIG. 2B) in which the first shaft 225 is outside of the locking cylinder and the pivot connection 230 is at least partially exposed.

When the locking cylinder 250 is in the first position, the locking cylinder 250 retains the first and second shafts 215, 225 in a substantially coaxial position. When the locking cylinder 250 is in the second position, enough of the pivot connection 230 is exposed to permit the first shaft to pivot relative to the second shaft.

A bias mechanism 255 can be provided to urge the locking cylinder 250 towards the first position. In a particular embodiment, the bias mechanism 225 comprises a spring 260 mounted adjacent the second end 227 of the second shaft 225 and held in place with an end cap 265 attached to the second end 227, such as by a threaded connection. Other bias mechanism can be used as well. Alternatively, the locking cylinder 250 can be retained in the first position with a locking mechanism, such as a spring loaded ball stopper, a removable pin, or other mechanism known to those of ordinary skill that can selectively keep the locking cylinder 250 in the first position.

Figure 3A:
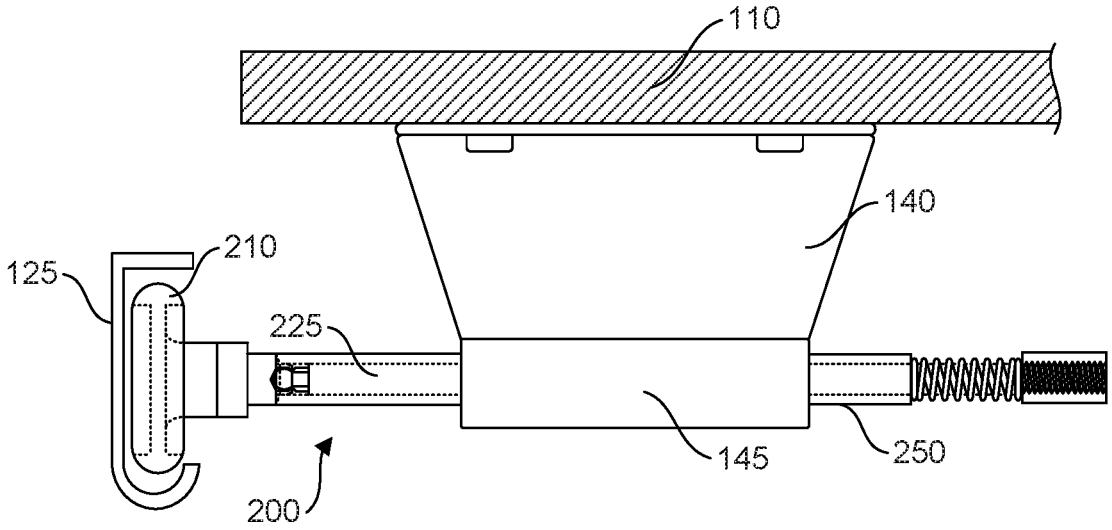
FIGS. 3A-3B show operation of the improved roller assembly to allow removal of the wheel from the track.
Figure 3B:
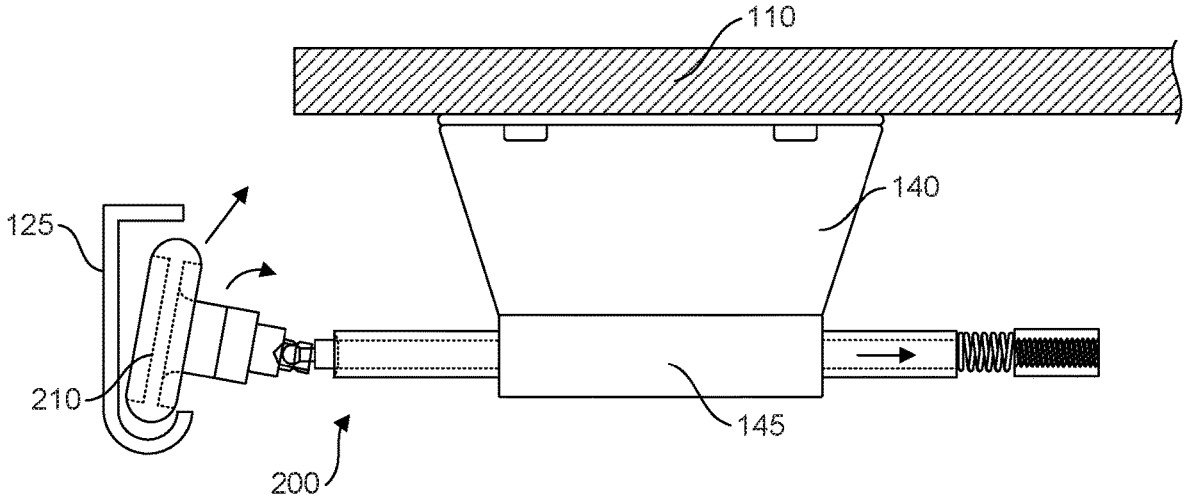

FIGS. 3A and 3B show use of the roller assembly 200 with a vertical door. The locking cylinder 250 (and second shaft 225 within) is inserted into support 145 of a bracket 140 attached to a door panel 110. In FIG. 3A, the locking cylinder 250 is in the first position and the wheel 210 is mounted in the J-track 125. The locking cylinder 250 prevents the first and second shafts 215, 225 from pivoting with respect to each other more than a minimal amount. In this position, the roller assembly 200 operates like a conventional door roller. In FIG. 3B, the locking cylinder 250 is moved to the second position. This allows the first shaft 215 to pivot relative to the second shaft 225, thereby permitting the wheel to be pivoted out of the J-track 125 removed from a door lift track of a vertical door when the door roller assembly is mounted to the door and the wheel is positioned in the track. To reseat the wheel 210 in the track the process is simply reversed.

To make it easier to grip and move the locking cylinder 250 between the first and second positions, an inner end portion 252 of the locking cylinder 250 can be knurled or provided with another type of textured surface. The mid-region 254 of the locking cylinder (See FIG. 2C) that will ride within the support 145 of a bracket 140 or a hinge when the roller assembly 200 is installed on a door is preferably smooth so the locking cylinder 250 can easily slide back and forth and also rotate as may be needed as the door is raised and lowered.

The dimensions of the various components of the roller assembly 200 depend to some extent on the particular environment to which the roller will be used. The diameter of the wheel 210 and outer diameter of the locking shaft should match the size of the J-track and the mounting brackets used. For a conventional 2 inch track, a standard wheel has an outer diameter of about 1 and ⅞ inches and the stem has an outer diameter of about ⅜ inch. A heavy duty roller has a wheel outer diameter of about 1 and 13⁄16 inches and a stem outer diameter of about 7⁄16 inch (0.44 inches)

In a particular embodiment of the improved roller assembly 200 for use as a replacement for a heavy duty roller as above, the locking tube 254 has an outer diameter D4 of about 0.44 inch and an inner diameter D1 of about 0.27 inch. The second shaft diameter D3 is slightly less than D1, about 0.26 inch. In the illustrated embodiment, an outer diameter D2 of the socket 240 at the end 217 of the first shaft 215 is substantially the same as the diameter D3. The first shaft can have a shoulder portion 218 at the inner side of the socket 240 with a diameter D5 substantially equal to the outer diameter D4 of the locking cylinder 250. The shoulder 218 provides a stop for the end of the locking cylinder when it is in the first position as shown in FIG. 2A. The ball 235 can have a diameter D6 of about 0.19 inch and the socket have an inner diameter D7 of about 0.21 inch.

In the illustrated embodiment, the locking cylinder should have a length at least sufficient for it to extend past the end of the support on the bracket to which it is intended for use with and the second shaft length should be longer than the locking cylinder to provide space for the bias mechanism. In one configuration, the locking cylinder length is at least 4.5 inches and the second shaft extends has a length of about one inch longer than the length of the locking cylinder.

The specific dimensions of the various components can be varied and scaled according to the desired size of the stem and the type of pivot joint and locking mechanism used.

While the illustrated embodiment selectively locks the pivot joint by use of a locking cylinder mounted over the second shaft, alternative locking mechanisms can also be used. For example, a much shorter locking cylinder could be provided that rides primarily on the first shaft and slides over the pivot joint towards the second shaft to lock the first and second shafts in position. Instead of a locking cylinder, the pivot joint could instead be locked in place with a pin that runs through the joint or an elastic clip that snaps over the joint. Removing the pin or clip would unlock the pivot joint. In yet a further variation, an axial bore could be formed in the first and second shafts and the pivot joint.

As a further alternative, instead of a locking cylinder surrounding the second shaft, an axial locking pin could be inserted through the axial bore in the first and second shaft and the pivot joint when the first and second shafts are aligned. In this position, the axial pin would lock the pivot joint. Partially withdrawing the axial pin would unlock the pivot joint. A bias mechanism, such as a spring, could be provided to urge the pin into the locked position.

Figure 4:
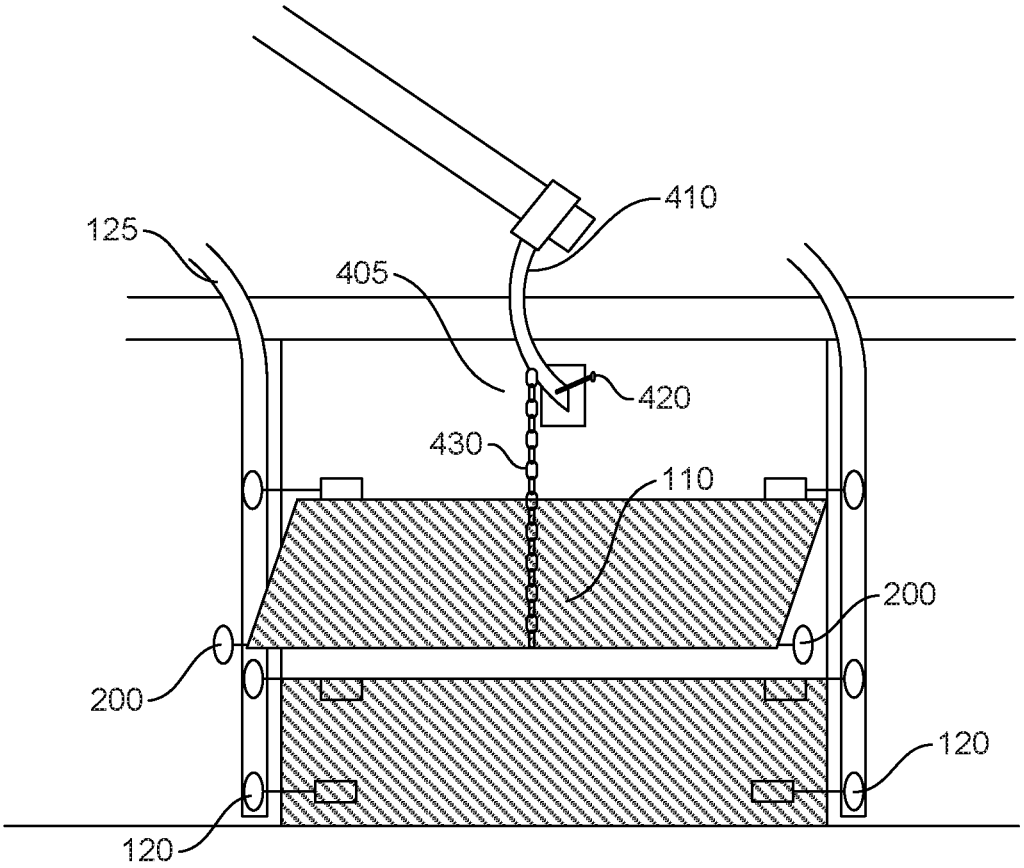
FIG. 4 shows an exemplary use of the improved roller assembly when mounted on a garage door.

As shown in FIG. 4, using the improved roller assembly 200 to couple the top corners of the top panel of the door 100 to the J-track 125 advantageously allows the top panel to be easily disconnected from the track and lowered. This opens up the top of the door providing an open area 405 for ventilation and improved lighting. The bottom part of the door remains closed, providing a barrier to entry.

Depending on how the door 100 is connected to the lift assembly, the connector to the lift assembly may need to be temporarily disconnected. There are various ways in which this can be configured. In one embodiment, a lifter arm 410 can be coupled to a bracket on the door panel and connected with a retaining pin 420. The arm connection to the door can be released by removing the retaining pin 420. Other mechanisms can also be used. A chain, rope, cable, or similar element 430 can also be connected to the lifter arm 410 and the door panel to allow the door panel to be more easily lowered and lifted.

Figure 5B:
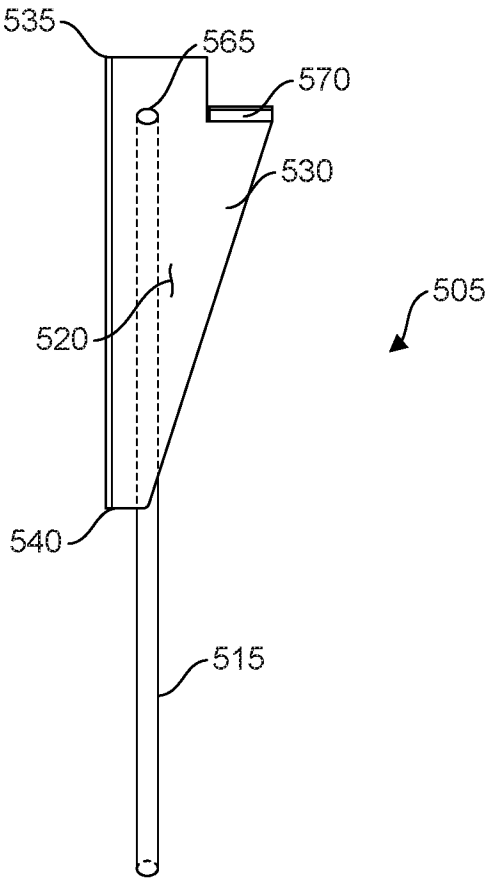
FIGS. 5A-5F illustrate a door panel support that can be used in conjunction with a door panel having the improved roller assembly.
Figure 5A:
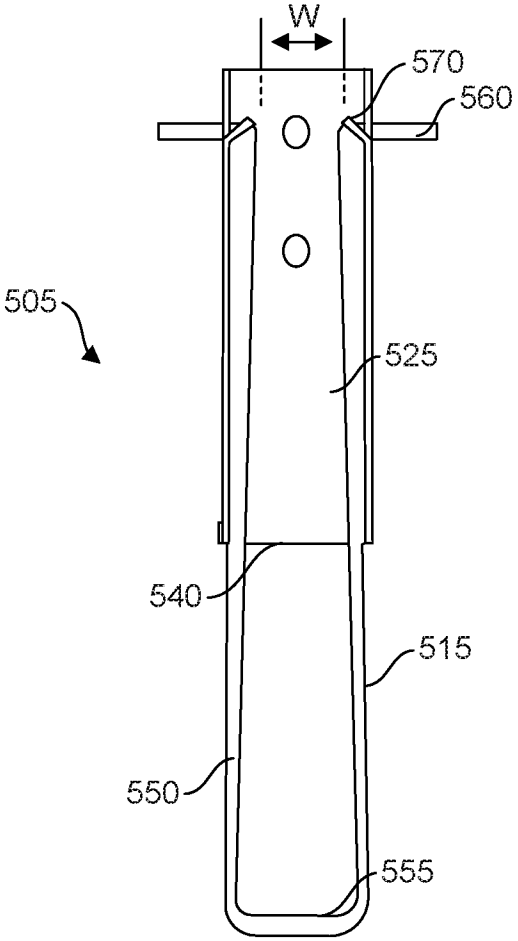
Figure 5C:
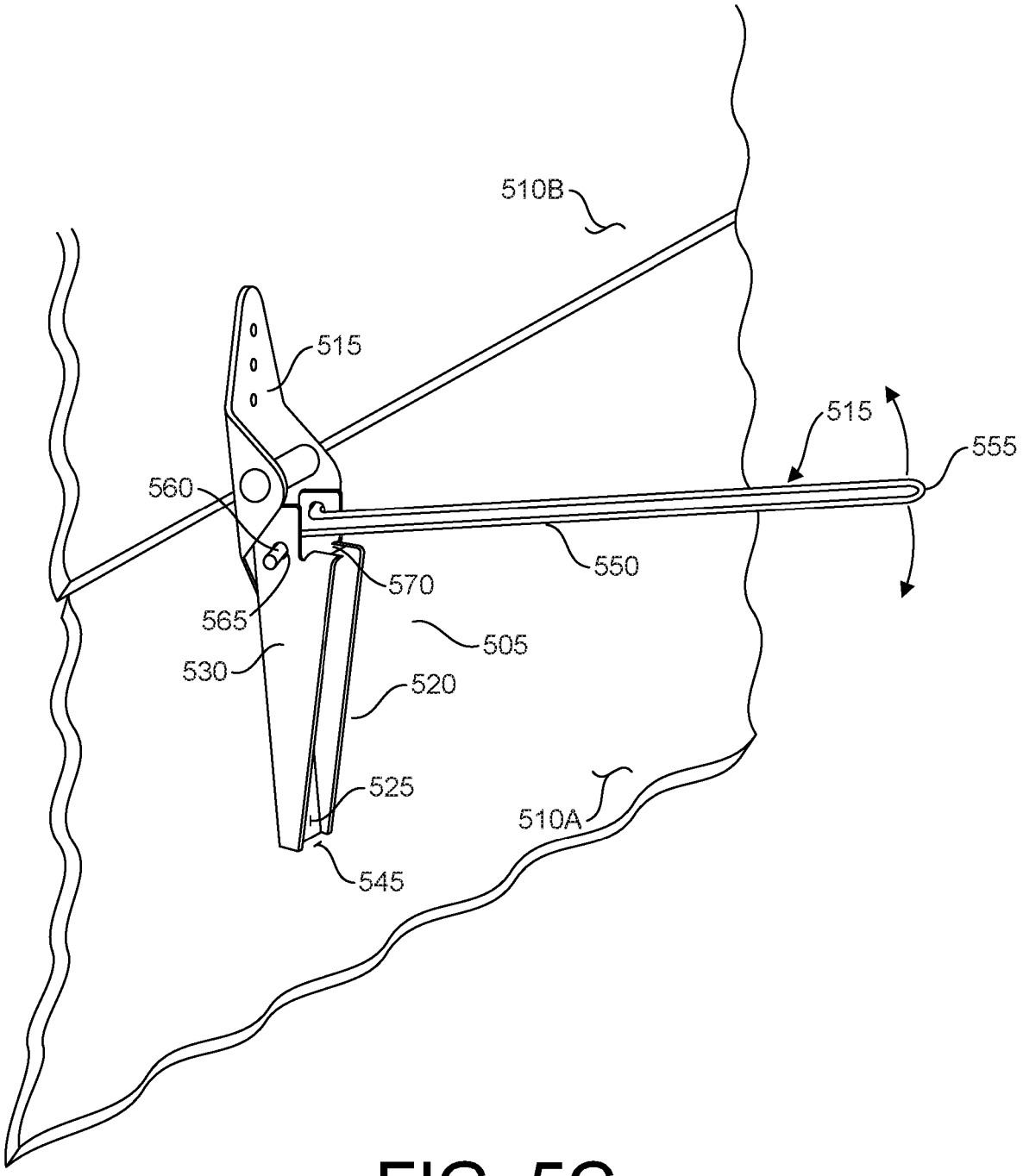

As an alternative or in addition to use of a cable 430, a deployable support bracket can be used to support a lowered door panel. FIGS. 5A and 5B show side and front views, respectively, of an embodiment of a support bracket 505. FIG. 5C shows support bracket 505 mounted on a door panel 510A beneath a hinge 515 that connects door panel 510A to an adjacent door panel 510B.

Bracket 505 comprises an elongated U-Shaped support 515 that is hingedly mounted into a body 520. The body 520 has a base 525 with a first end 535 and a second end 540. Two opposing sides 530 extend upwards from the base 525 and define a channel 545. The support 515 has a pair of elongated arms 550 extending from an outward end 555. Each arm 550 is rotationally coupled to a side 530, such as by means of an arm extension 560 extending at approximately a right angle from an end of the arm opposite the outward end 555 of support 515 and passing through a respective hole 565 in wall 530.

Figure 5D:
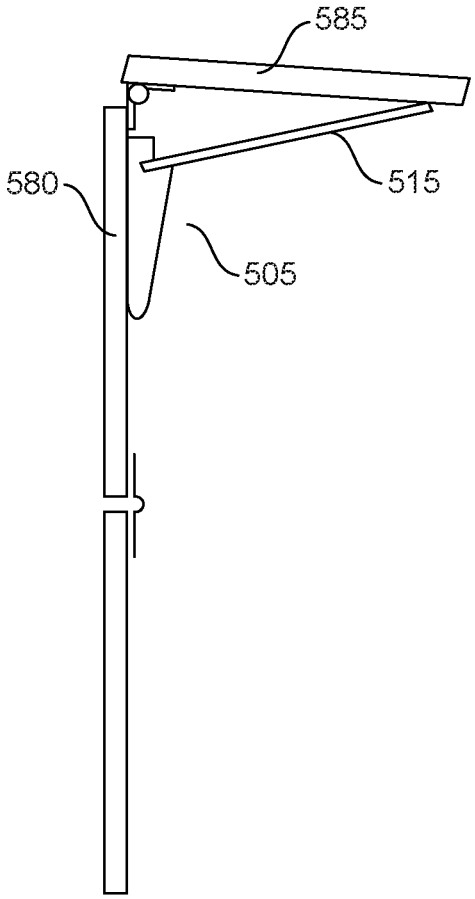

Opposing and inward facing shoulders 570 are formed along a portion of each wall 530 near the point where the arms 550 are coupled to the walls 530. FIG. 5C shows the support 515 in a deployed position. In this position, the shoulders 570 will prevent the support 515 from rotating downwards. The surface of the inward shoulders 570 can be tilted so as to urge the arms 550 apart from each other when weight is placed on the shoulder. The support 515 is made of a rigid material, such as a steel bar or other material that is at least partially elastic. Arms 550 can can be squeezed together to reduce the distance between the arms in the area of the shoulders 570 to less than a gap width W between the two shoulders 570, thereby allowing the support 515 to move between a stowed position within the channel 545 as shown in FIGS. 5A and 5B and a deployed position as shown in FIG. 5C. With reference to FIG. 5D, a bracket 505 can be mounted on a door panel 580 below a door panel 585 that can be decoupled from the track and lowered as discussed herein. The support 515 of the bracket 505 in the deployed position can support door panel 585 when lowered.

Figure 5F:
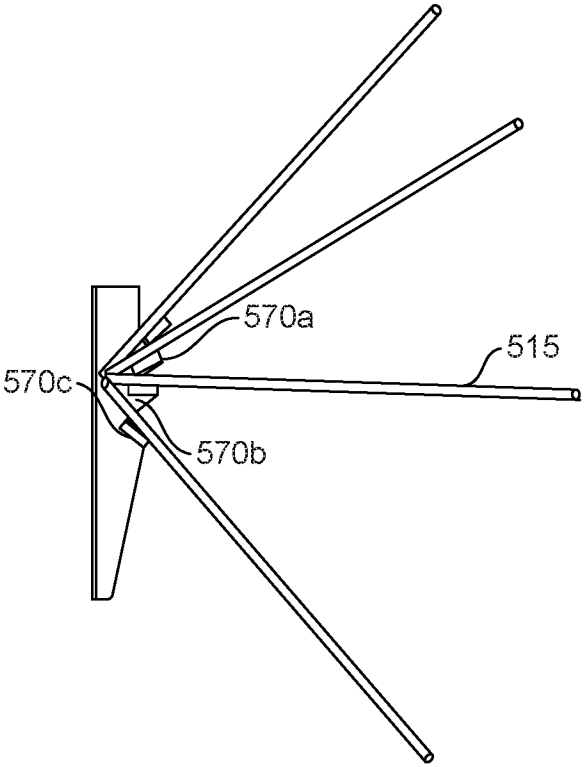
Figure 5E:
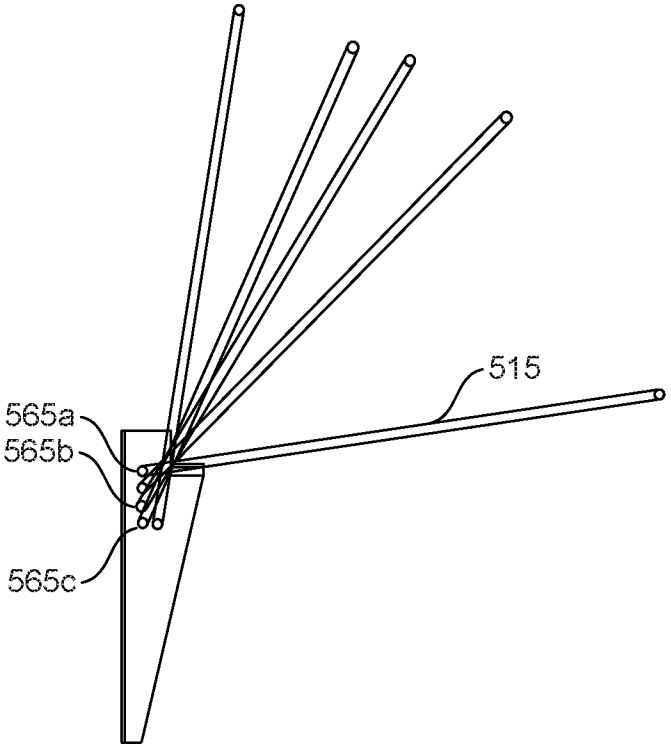

The position of the hole 565 relative to the shoulder 570 determines the angle of the support 515 relative to the body 520. As shown in FIG. 5E, multiple pairs of opposing holes can be provided in each side 530, such as holes 565*a*, 565*b*, and 565*c*. A user can vary the angle of the support 515 by mounting the support 515 into different pairs of holes. In an alternative, and as shown in FIG. 5F, multiple shoulders can be provided for use with a support 515 mounted in a single hole, such as shoulders 570*a*, 570*b*, and 570*c*. The user can vary the angle of the support arm by selecting the particular pair of shoulders as a rest for the support. Each shoulder can be angled so that it defines a plane that at least approximately reflects the angle of the support 515 when placed on that shoulder.

By selecting appropriate combinations of hole and shoulder position the support bracket 505 can hold an upper door panel decoupled from the track at an angle from only a few degrees, such as about 5 to 10 degrees, where the door panel is open only slightly and provides some ventilation while preserving privacy, to nearly 180 degrees, where the panel is almost fully dropped down. Rubber or plastic coverings can be added to the support 515 and the bracket body 520 to reduce the likelihood that the support 505 will scratch a supported door panel.

Various aspects, embodiments, and examples of the invention have been disclosed and described herein. Modifications, additions and alterations may be made by one skilled in the art without departing from the spirit and scope of the invention as defined in the appended claims.

The invention claimed is:

1. A vertical lift door roller assembly comprising:

a support configured to be mounted to a vertical lift door;

a wheel;

a first shaft extending from the wheel along a central axis, the first shaft coupled to the wheel at an inner end and having an outer end;

a second shaft with inner and outer ends, the inner end of the second shaft connected to the outer end of the first shaft with a pivot joint, the second shaft positionable along the central axis;

a locking cylinder surrounding at least a portion of the second shaft and movable between (i) a first position in which the locking cylinder surrounds at least a portion of the first shaft and the portion of the second shaft and (ii) a second position in which at least a portion of the pivot joint is outside of the locking cylinder;

wherein the locking cylinder is mounted within the support;

wherein when the locking cylinder is in the first position the first and second shafts are retained in a substantially coaxial position and when the locking cylinder is in the second position the first shaft can pivot relative to the second shaft.

2. The assembly of claim 1, further comprising a bias mechanism urging the locking cylinder towards the first position.

3. The assembly of claim 1, wherein the locking cylinder has an inner end facing the wheel and an outer end, the outer end of the second shaft extending past the outer end of the locking cylinder.

4. The assembly of claim 3, further comprising a stop on the outer end of the second shaft and a spring mounted on the second shaft between the stop and the outer end of the locking cylinder.

5. The assembly of claim 4, wherein the stop is threadedly engaged to the second shaft.

6. The assembly of claim 1, wherein a portion of the locking cylinder adjacent the outer end is knurled.

7. The assembly of claim 1, wherein the pivot joint is a ball and socket joint.

8. The assembly of claim 7, wherein the ball and socket joint comprises a socket formed in the outer end of the first shaft and a ball connected the inner end of the second shaft and mounted in the socket.

9. The assembly of claim 1, wherein the first shaft has an outer diameter and the second shaft has an outer diameter substantially equal to the outer diameter of the first shaft.

10. The assembly of claim 1, the support comprising a hollow support cylinder;

the locking cylinder having outer and inner ends and extending into the support cylinder, wherein one of the inner and outer ends of the locking cylinder is external to the support cylinder.

11. The assembly of claim 10, wherein the locking cylinder has a length that is greater than a length of the support cylinder.

12. The assembly of claim 11, wherein the locking cylinder extends entirely through the support cylinder and each of the inner and outer ends of the locking cylinder are external to the support cylinder.

13. A vertical lift door assembly comprising:

a door having a front, a back, first and second edges, a top, and a bottom, the door comprising a plurality of rectangular panels, adjacent panels of the plurality of panels being connected with a plurality of hinges;

a roller comprising a wheel and a stem coupled to a central axis of the roller;

a support attached to a front of a respective panel of the plurality of panels, the support adjacent to a first edge of the respective panel;

the stem of the roller comprising:

a first shaft having a central axis extending from the wheel along the central axis of the first shaft, the first shaft coupled to the wheel of the roller at an inner end and having an outer end;

a second shaft with an inner end and an outer end, the inner end of the second shaft connected to the outer end of the first shaft with a pivot joint, the second shaft positionable to align with the central axis of the first shaft;

a locking cylinder surrounding at least a portion of the second shaft and movable between (i) a first position in which the locking cylinder surrounds at least a portion of the first shaft and the portion of the second shaft and (ii) a second position in which at least a portion of the pivot joint is outside of the locking cylinder;

the locking cylinder of the stem being mounted within the support;

wherein when the locking cylinder of the stem is in the first position the first and second shafts of the stem are retained in a substantially coaxial position and when the locking cylinder is in the second position the first shaft can pivot relative to the second shaft of the stem to permit the wheel of the roller, when mounted in a door lift track, to be removed from the door lift track.

14. The assembly of claim 13, the roller further comprising a bias mechanism urging the locking cylinder of the stem towards the first position.

15. The assembly of claim 14, wherein the bias mechanism of the roller comprises a spring mounted on the second shaft of the stem between an outer end of the second shaft and an outer end of the locking cylinder.

16. The assembly of claim 13, wherein the pivot joint of the stem is a ball and socket joint.

17. The assembly of claim 13, wherein the first shaft of the stem has an outer diameter and the second shaft of the stem has an outer diameter substantially equal to the outer diameter of the first shaft.

18. The assembly of claim 13, wherein the respective panel is a top panel of the door and the plurality of rectangular panels further including a second panel adjacent to and below the top panel, the top panel connected to the second panel with respective hinges of the plurality of hinges, the assembly further comprising:

a bracket mounted to the second panel and having an elongated support arm rotationally attached thereto, the support arm being movable from a stowed position generally adjacent the second panel to a deployed position extending outwards from the second panel, wherein when the support arm is in the deployed position it can provide support for the top panel when the top panel is not connected to the door lift track and the top panel is lowered on the respective hinges connecting the top panel to the second panel.

19. The assembly of claim 13, the support comprising a hollow support cylinder;

the locking cylinder having outer and inner ends and extending into the support cylinder, wherein one of the inner and outer ends of the locking cylinder is external to the support cylinder.

20. The assembly of claim 19, wherein the locking cylinder has a length that is greater than a length of the support cylinder.

21. The assembly of claim 20, wherein the locking cylinder extends entirely through the support cylinder and each of the inner and outer ends of the locking cylinder are external to the support cylinder.

22. The assembly of claim 13, wherein the respective panel is a top panel of the door.

* * * * *